US011613899B1

(12) United States Patent
Oliphant et al.

(10) Patent No.: US 11,613,899 B1
(45) Date of Patent: Mar. 28, 2023

(54) LOAD TRANSFER ARRANGEMENT FOR A MULTI-PART POLE HAVING A FLANGED CONNECTION

(71) Applicant: Exo Group LLC, Magnolia, TX (US)

(72) Inventors: Wesley J. Oliphant, Tomball, TX (US); Zachary J Oliphant, Magnolia, TX (US)

(73) Assignee: EXO Group LLC, Magnolia, TX (US)

( * ) Notice: Subject to any disclaimer, the term of this patent is extended or adjusted under 35 U.S.C. 154(b) by 0 days.

(21) Appl. No.: 17/502,104

(22) Filed: Oct. 15, 2021

Related U.S. Application Data

(60) Provisional application No. 63/118,995, filed on Nov. 30, 2020.

(51) Int. Cl.
*E04G 23/02* (2006.01)
*E04H 12/22* (2006.01)

(52) U.S. Cl.
CPC ..... *E04G 23/0225* (2013.01); *E04H 12/2292* (2013.01)

(58) Field of Classification Search
CPC . E04G 23/02; E04G 23/0218; E04G 23/0225; E04B 2001/246; E04H 12/085; E04H 12/2292; Y02E 10/70; Y02E 10/72; E02D 5/60; E02D 5/64; F03D 13/20; Y10T 403/50; Y10T 403/551; Y10T 403/5781
USPC ..... 52/514
See application file for complete search history.

(56) References Cited

U.S. PATENT DOCUMENTS 1,486,594 A * 3/1924 Malome ..... E04H 12/2292 52/154
1,489,322 A * 4/1924 Hogan ..... E04H 12/2292 52/835
4,032,244 A * 6/1977 Quayle ..... E02D 5/523 405/251
4,986,687 A * 1/1991 Ivey ..... H02G 7/00 403/2
6,901,717 B2 * 6/2005 Brunozzi ..... E04H 12/2292 52/294
7,815,157 B2 * 10/2010 Knight ..... E04H 12/2292 256/65.14
8,209,913 B2 * 7/2012 Murata ..... E04H 12/08 52/844
8,322,757 B2 * 12/2012 Ma ..... E04H 12/28 285/412
9,038,353 B2 * 5/2015 Huncovsky ..... E04G 23/0218 403/312
9,127,650 B2 * 9/2015 Moestrup ..... E04H 12/342
9,153,853 B2 * 10/2015 Lassiter ..... E04H 12/20
(Continued)

FOREIGN PATENT DOCUMENTS

CN 204199830 U * 3/2015
CN 109653528 A * 4/2019 ..... E04G 23/0218
(Continued)

*Primary Examiner* — Ryan D Kwiecinski
(74) *Attorney, Agent, or Firm* — Duncan Galloway Greenwald PLLC; Kevin T. Duncan

(57) ABSTRACT

An arrangement for making a field repair on a multi-part pole having upper and lower walls joined together by a flanged connection that is beginning to show signs of failure. The arrangement includes upper and lower C-channels secured to the upper and lower walls of the pole, respectively and a front plate secured to said upper and lower C-channels and spanning the flanged connection.

4 Claims, 7 Drawing Sheets

(56) References Cited

U.S. PATENT DOCUMENTS

| | | | | |
|---|---|---|---|---|
| 9,487,960 | B2 * | 11/2016 | Kent | E04G 3/30 |
| 9,777,500 | B1 * | 10/2017 | Reisdorff | E04H 12/2215 |
| 9,822,537 | B2 * | 11/2017 | Garcia | F03D 80/80 |
| 11,072,941 | B1 * | 7/2021 | Oliphant | B23P 6/00 |
| 2007/0256388 | A1 * | 11/2007 | Ianello | E04H 12/2292 52/651.07 |
| 2011/0138729 | A1 * | 6/2011 | Shiraishi | F03D 13/20 52/651.01 |
| 2014/0053500 | A1 * | 2/2014 | Lassiter | E04H 12/00 52/745.17 |
| 2016/0060889 | A1 * | 3/2016 | Tedesco | E04H 12/2238 52/514 |

FOREIGN PATENT DOCUMENTS

| | | | | | |
|---|---|---|---|---|---|
| CN | 110300849 | A | * | 10/2019 | F03D 13/20 |
| CN | 113565067 | A | * | 10/2021 | |
| CN | 215804956 | U | * | 2/2022 | |
| JP | 2017040088 | A | * | 2/2017 | |

* cited by examiner

LOAD TRANSFER ARRANGEMENT FOR A MULTI-PART POLE HAVING A FLANGED CONNECTION

BACKGROUND

The present invention relates to a device and method to repair or reinforce a multi-part pole, wherein a flanged connection between adjacent upper and lower sections of the pole has been weakened.

For example, utility companies have power transmission poles that support power lines. The pole sections are connected together at flanged joints. There may be weld cracking in the welds that connect the flanges to the pole sections, and those welds may weaken over time. It is very expensive to replace the poles and very expensive to try to repair all of the welds. The power lines are energized, and the poles hold tension from the wires and from the wind loads acting on them.

SUMMARY

Multi-part load-transfer brackets are provided, which are relatively easy to install and which provide support around the weakened flange joints. Each load-transfer bracket includes an elongated upper C-channel, and an elongated lower C-channel. The upper C-channel is secured to the upper wall of the pole above the flanged joint, and the lower C-channel is secured to the lower wall of the pole below the flanged joint using blind fasteners. A plate mounts to the upper and lower C-channels, spanning across the weakened flange area. The brackets support the forces that previously were supported by the flanged joint, effectively bypassing the welds and flanges.

DESCRIPTION

Figure 1:
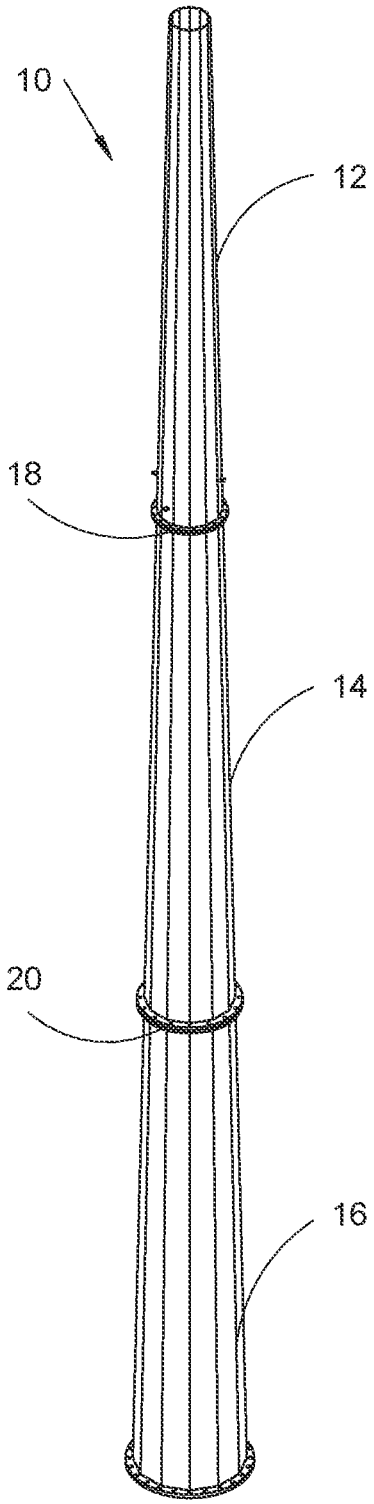
Fig 1 Prior Art
FIG. 1 is a perspective view of a prior art multi-part, multi-sided pole, showing an upper pole portion, a middle pole portion, and a lower pole portion, with flanged joints connecting the upper and middle pole portions and flanged joints connecting the middle and lower pole portions.
Figure 4:
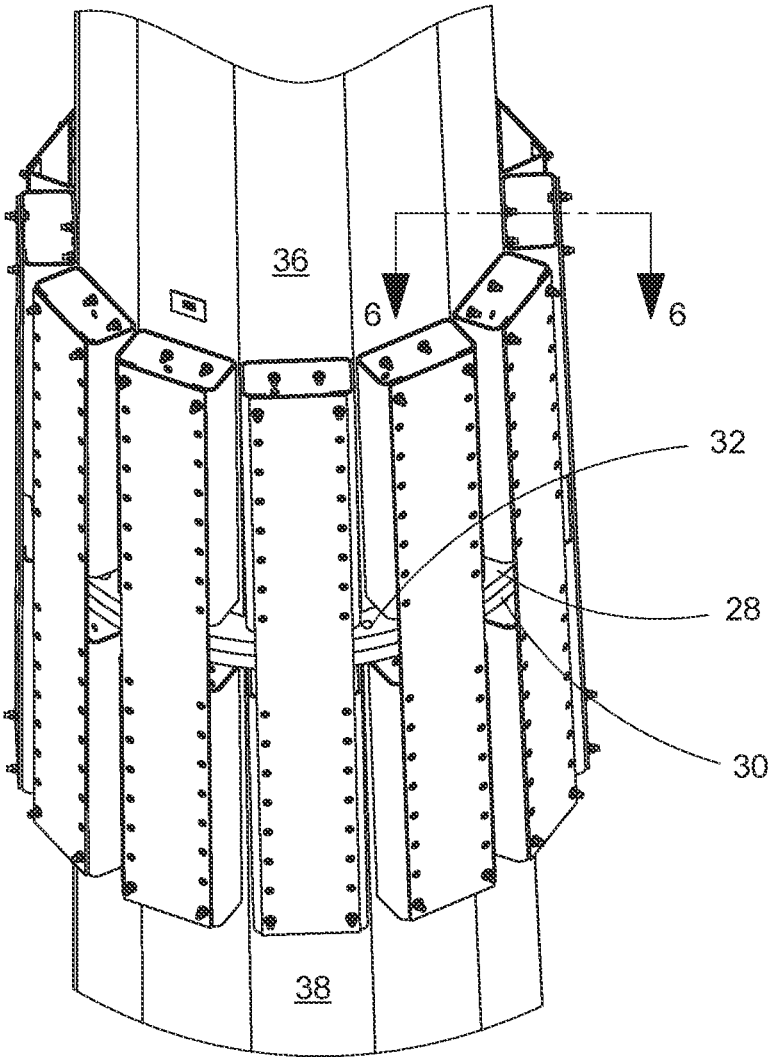
FIG. 4 is a broken-away, perspective view of the repaired flanged joint between the middle pole portion and the lower pole portion of FIG. 2.

FIG. 1 is a perspective view of a prior art, hollow, multi-sided, multi-section pole 10, including a first pole portion 12, a second pole portion 14 and a third pole portion 16, with an upper flanged connection 18 at the juncture of the first and second pole portions 12, 14 and a lower flanged connection 20 at the juncture of the second and third pole portions 14, 16 respectively. In this particular embodiment, the pole 10 is a 12-sided metal pole having 12 flat sides. The flanged connection 18 includes an upper flange 22, a lower flange 24, (See FIG. 10) and a plurality of bolts 26 that secure the flanges 22, 24 together. The upper flange 22 is welded to the lower end of the first pole portion 12, and the lower flange 24 is welded to the upper end of the second pole portion 14. The flanged connection 20 includes an upper flange 28, a lower flange 30, (See FIG. 4) and a plurality of bolts 32 that secure the flanges 28, 30 together. The upper flange 28 is welded to the lower end of the second pole portion 14, and the lower flange 30 is welded to the upper end of the third pole portion 16. Bending moments, due to factors such as wind loading as well as the weight of any items which hang off of or are otherwise supported by the pole 10, are transmitted from the first pole portion 12 to the second pole portion 14 via the welds between first and second pole portions 12, 14 and their corresponding upper and lower flanges 22, 24. These bending moments also are transmitted from the second pole portion 14 to the third pole portion 16 via the welds between second and third pole portions 14, 16 and their corresponding upper and lower flanges 28, 30. (It is understood that a pole may include more or fewer than three portions connected together by flanged joints.)

After years of use, or due to inherent defects, these welds may begin to crack and eventually fail. When a field inspection indicates that the welds are beginning to crack, a plurality of brackets 34 (See FIG. 8), as described below, can be installed in the field to effectively replace the flange sets 22, 24 or 28, 30 and their respective welds 28W, 30W. (See FIG. 5 for the welds between the lower pole portion 16 and the middle pole portion 14.) The brackets 34 provide another mechanism for supporting and transferring the forces.

Following is a description of the hardware and method of repair of the flanged connection 20 between the third pole portion 16 and the second pole portion 14.

Figure 2:
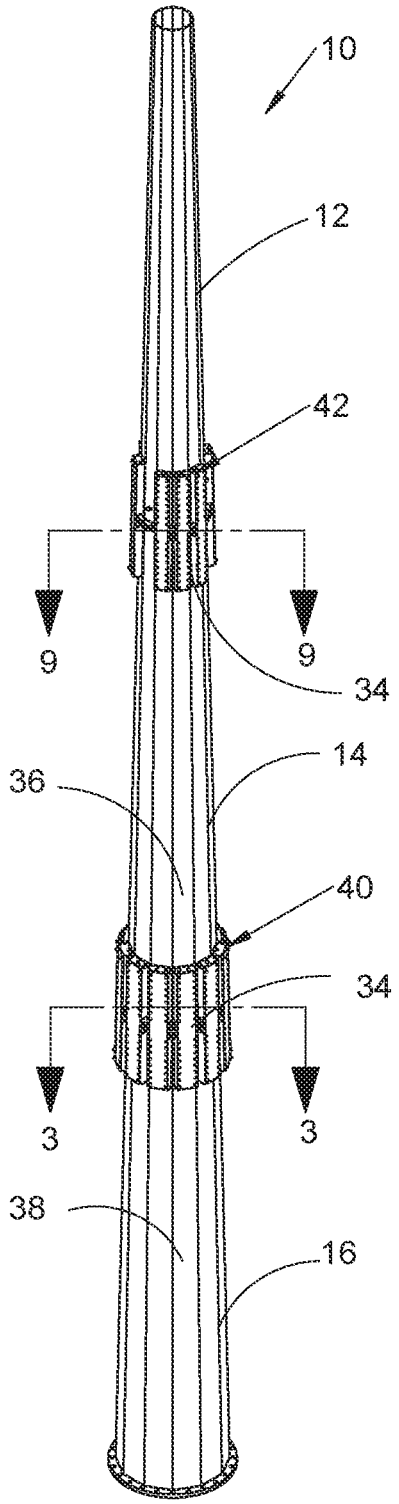
FIG. 2 is a perspective view of the pole of FIG. 1, with a plurality of load transfer brackets mounted on the pole, spanning the flanged joints.

FIG. 2 is a side view of the pole 10 of FIG. 1 with a plurality of multi-piece brackets 34 installed to make a repair 40 at the lower flanged-section and a repair 42 at the upper flanged-section, each bracket 34 spanning across the respective flanged joint 20 or 18 (See FIG. 1). The brackets 34 at each respective elevation are identical to each other. (The brackets 34 at the upper repair 42 are scaled to have smaller dimensions than the brackets 34 at the lower repair 40, in order to fit the smaller dimensions of the pole 10 at the higher elevation, since the pole 10 tapers from a larger diameter at the bottom to a smaller diameter at the top.) A perspective view of one of the brackets 34 is shown in FIG. 8.

Figure 3:
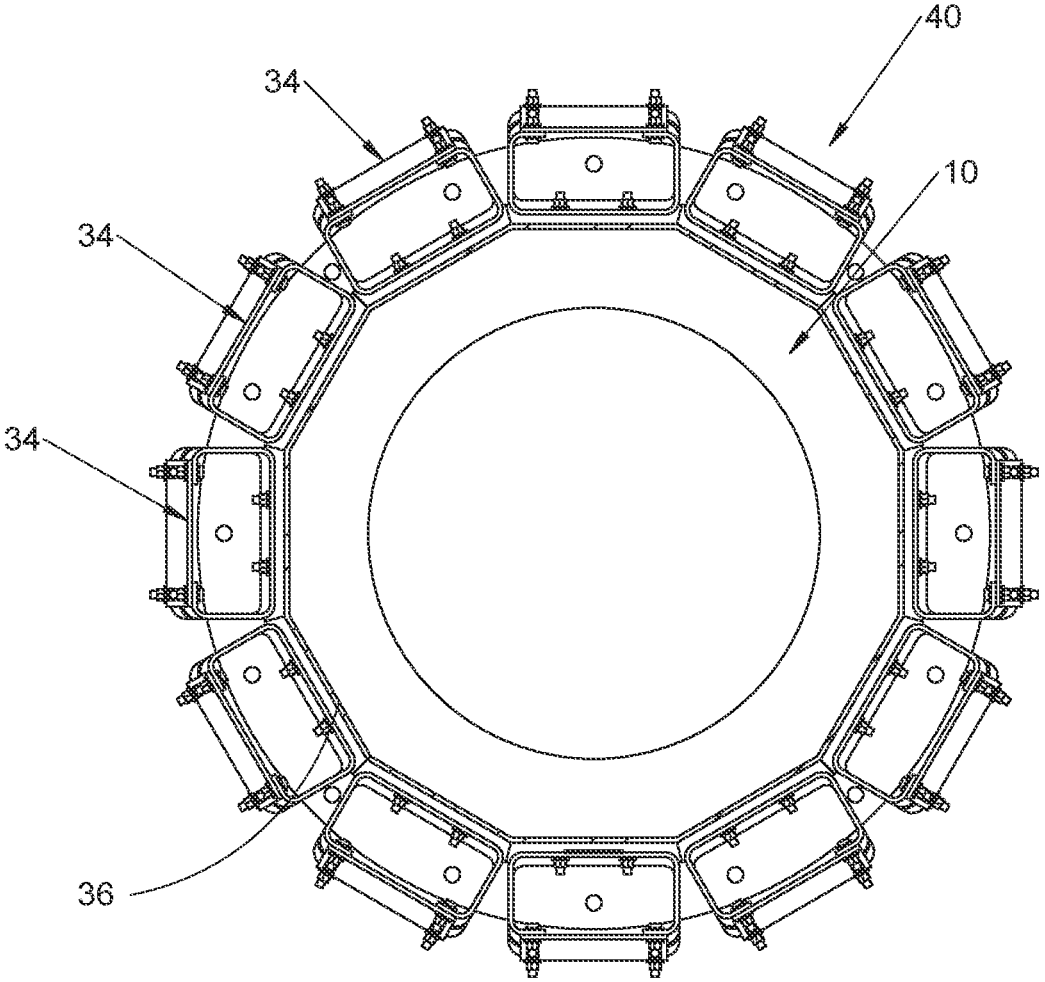
FIG. 3 is a view along section 3-3 of the pole of FIG. 2.

As best appreciated in FIG. 3, there are 12 brackets 34 mounted on the 12-sided pole 10 at the repair 40, with one bracket 34 mounted on each of the 12 sides of the pole 10. Each bracket 34 is secured to the walls 36, 38 (See FIG. 2) of the second and third pole portions 14, 16 respectively, along its respective side. It should be pointed out that it is not always necessary to have a bracket 34 for each side of the multi-sided pole 10, as is evidenced by the flanged section repair 42 (See FIG. 2) at the flanged connection 18 between the second pole portion 14 and the first pole portion 12. For instance, it would be possible to provide only 6 brackets 34 for a repair on the pole 10, wherein only every other side of the twelve-sided pole 10 receives a corresponding bracket 34. However, it is preferred that there be a bracket 34 on every side of a multi-sided pole. Of course, these brackets 34 could be used on poles with greater or fewer than 12 sides, with the number of brackets 34 adjusted accordingly. The brackets 34 also could be used on circular cross-section poles. In that case, the rear surfaces of the upper and lower elongated C-channel portions of the bracket 34, as described later, preferably would be curved to match the shape of the surfaces against which they are mounted.

Figure 6:
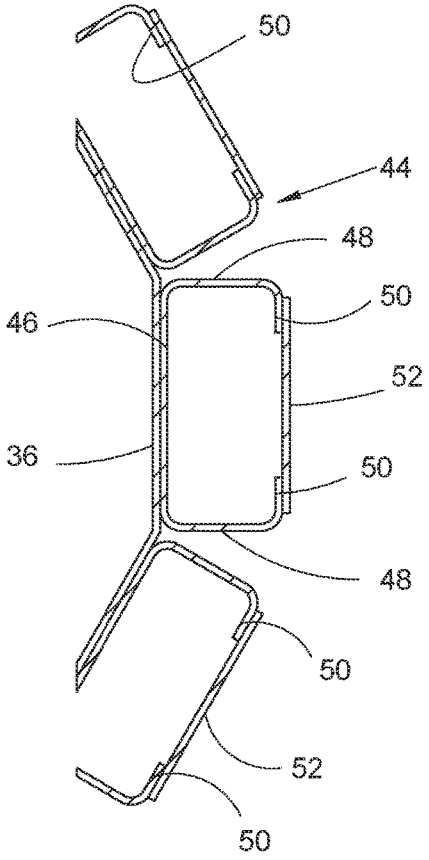
FIG. 6 is a broken-away view taken along section 6-6 of FIG. 4.
Figure 7:
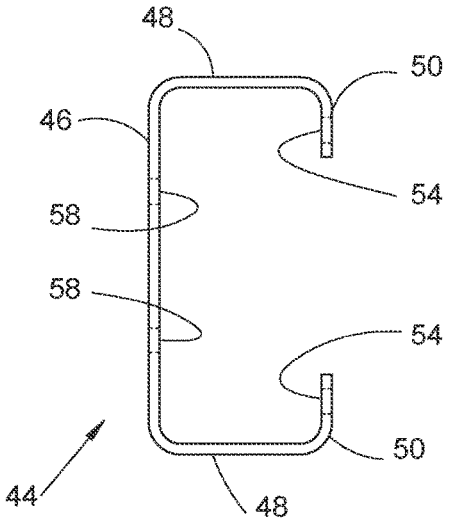
FIG. 7 is a top view of one of the C-channels of FIGS. 3 and 6.
Figure 8:
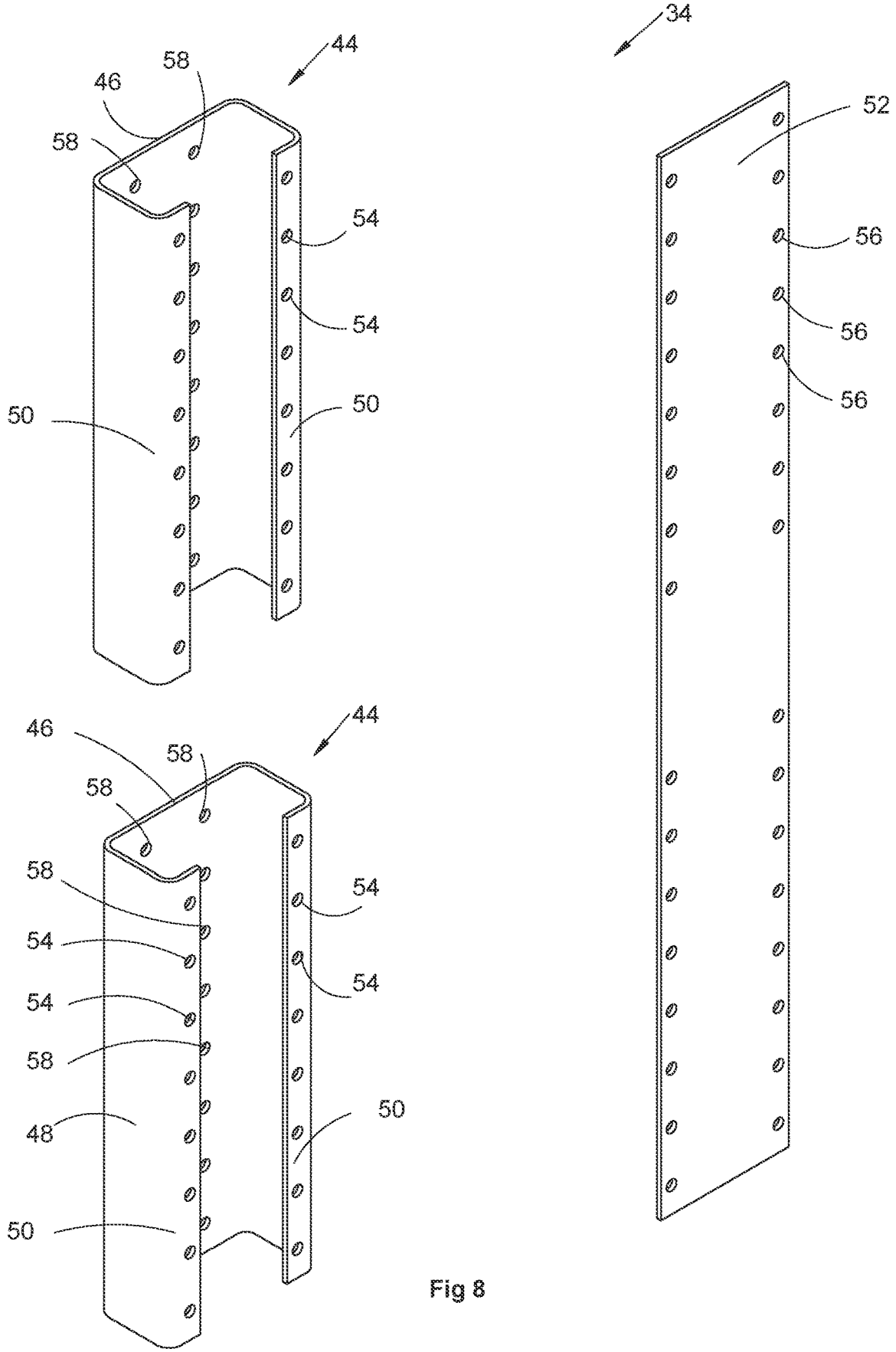
FIG. 8 is an exploded, perspective view of a load-transfer bracket of FIG. 4.

As best appreciated in FIGS. 6-8, the bracket 34 has symmetrical upper and lower elongated C-channels 44. Each C-channel has a rear surface 46, left and right forwardly-projecting arms 48, and left and right inwardly-projecting fingers 50, which form the front surface of the C-channel 44. In this embodiment, the C-channels 44 are flat on the rear surface 46 in order to lie flat against the respective walls 36, 38 of the second and third pole portions 14, 16. (If the pole had a curved outer surface, the C-channels 44 would be made with a rear surface that matched that curved shape in order to lie flush against at least a portion of the outer surface of the pole.)

Figure 5:
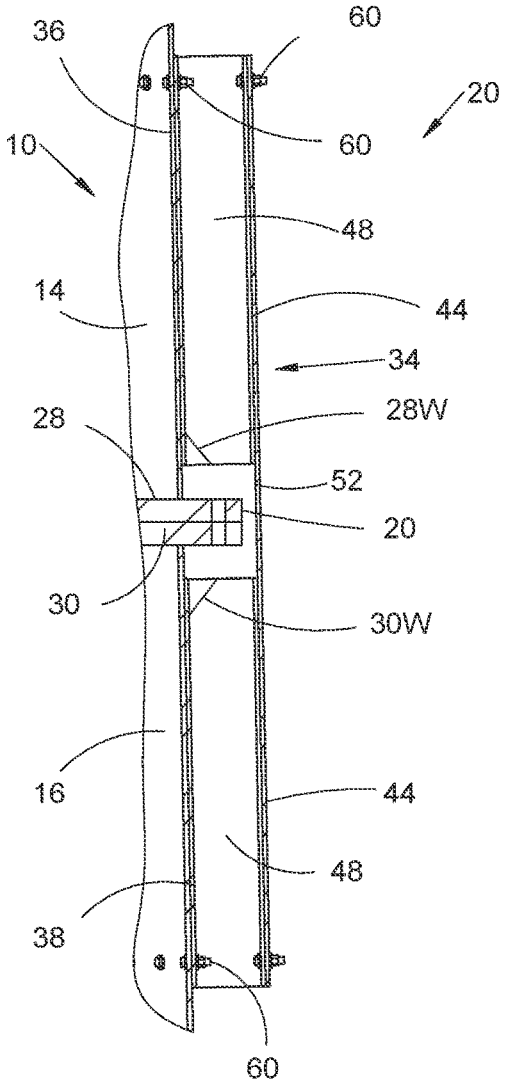
FIG. 5 is a broken-away, side view of one of the installed load-transfer brackets of FIG. 4.

The profile of each C-channel 44 is the same along the full length of the channel 44. The profile is best shown in FIG. 7. The a rear wall 46 is sized to span a substantial portion of the side of the pole portion 36 or 38 to which it is attached, as best shown in FIG. 6. The left and right forwardly-projecting arms 48 have a sufficient depth so that the flange connection 20 does not protrude beyond the front faces of the C-channels 44, which enables the front plate 52 (See FIGS. 5, 6, and 8) mounted onto the front faces of the upper and lower C-channels 44 to span across the protruding flange connection 20, as best shown in FIG. 5.

The left and right inwardly projecting fingers 50 extend a short distance toward each other to form the front face of the C-channel 44. Each finger 50 defines a plurality of through openings 54 (See FIG. 8) which are located to match up with corresponding through openings 56 on the front plate 52, as described in more detail later. The rear wall 46 of the C-channel 44 also defines a plurality of through openings 58 (See FIGS. 7 and 8) which are used to secure the C-channel 44 to the pole 10, via blind fasteners, as explained in more detail later. The location of the openings 58 on the rear wall 46 of the C-channel 44 is such that they are accessible for installation of blind fasteners 60 (see FIG. 5 which only shows one of these fasteners 60 per C-channel 44, but it is understood that each of the openings 58 would receive a fastener 60) without interference by the fingers 50. There are left and right columns of openings 58 on each rear wall 46, and, as shown in FIG. 7, those openings 58 are located directly behind the left-to-right space formed between the ends of the left and right fingers 50 to provide easy access to install the fasteners 60.

Each C-channel 44 in this particular embodiment is made from ½" thick steel and is approximately 4 feet long, and weighs about 260 pounds. Twenty-four of these C-channels 44 are used for the flanged section repair 40. (12 on the second pole portion 14 and another 12 on the third pole portion 16) The plate 52 also is ½" thick. The plate is just over 9 feet long, weighing about 230 pounds. There are 12 of these plates 52 in the flanged section repair 40. Including the weight of the bolts 60, the material added to the pole 10 in this repair 40 is in excess of 9,000 pounds. However, the heaviest single piece, the C-channel 44, weighs only 260 pounds, which is considerably lighter and easier to manage than prior art one-piece brackets.

Installing the Repair 40:

To install each bracket 34 to the pole 10, an upper C-channel 44 is put into position on one side of the second pole portion 14 of the pole 10, and a first hole is drilled on the second pole portion 14 at the location of the uppermost opening 58 in the C-channel 44.

The drilling of this first hole through the second portion 14 of the pole 10 can be aided by the use of a magnetic base drill. Once this first hole is drilled, a first blind fastener 60 is installed through the upper opening 58 of the C-channel 44 and through the first drilled hole in the second pole portion 14 to hang the C-channel 44 onto the pole 10. This supports the weight of the C-channel. Then, with the C-channel properly oriented relative to the second portion 14 of the pole 10, the remaining holes 58 of the C-channel 44 are used as a template to accurately locate the additional holes to be drilled in the second pole portion 14. Once the positions of these additional holes are located, the magnetic base drill is used to readily drill the holes through the wall 36 of the second pole portion 14, and the upper C-channel 44 is secured to the pole 10 using the blind fasteners 60. (Blind fasteners are types of fasteners that can be installed without requiring the installer to have access to the back side of the fastener.)

The front plate 52 then is temporarily mounted onto the already-mounted upper C-channel 44 in order to determine the correct position for mounting a lower C-channel 44 onto the wall 38 of the third pole portion 16. A lower C-channel 44 is brought into position and is properly aligned with the front plate 52, and the position of a mounting hole 58 of the lower C-channel 44 is located on the lower wall 38. After removing or temporarily swinging away the front plate 52, a hole is drilled at that location on the wall 38 of the third pole portion 16, and the lower C-channel is mounted on the wall 38 using a blind fastener 60 extending through the mounting hole 58 and through the drilled hole in the wall 38. Then, the remaining holes 58 of the lower C-channel 44 are used as a template to accurately locate the additional holes to be drilled in the lower pole portion 16. Once the positions of these additional holes have been located, the magnetic base drill is used to drill the holes through the wall 38 of the third pole portion 16, and the lower C-channel 44 is secured to the pole 10 using the blind fasteners 60 extending through the respective holes 58 in the C-channel and through the drilled holes in the wall 38. This process is repeated until all the C-channels 44 have been installed. Finally, the front plates 52 are mounted onto respective upper and lower C-channels 44, spanning the flanged joint, using blind fasteners 60, each blind fastener 60 extending through aligned openings in the front plate 52 and in one of the left and right fingers 50.

As shown in FIG. 5, the upper and lower C-channels 44 are mounted to the upper and lower walls 36, 38 above and below the flanges 28, 30, and the front plates 52 span the upper and lower flanges 28, 30 of the flanged connection 20 and span the failing welds 28W, 30W.

Using these multi-piece brackets not only reduces the weight of each piece that has to be lifted and mounted onto the pole 10 to make the repair, but it also allows for easier alignment of each bracket with the pole 10. The sides of a first pole section may not align perfectly with the sides of an adjacent second pole section. Using separate C-channels for the first pole section and the second pole section permits each C-channel to be properly aligned with its respective side of its respective pole section.

It should be noted that, by using a plurality of individual multi-piece brackets 34, a wide range of pole types and sizes can be reinforced using just a single style of bracket. This is advantageous, as it reduces the number of different types of brackets that have to be made and carried into the field.

Blind fasteners 60 are used for the installation, because the installer usually does not have access to the inner surface of the hollow pole 10. Blind fasteners usually are multi-piece assemblies, which can be installed and tightened from one side of the workpiece. Typical examples of blind fasteners used in higher strength structural areas are Ajax™ bolts (manufactured by Ajax Fasteners of Australia) and ForgBolts™ (manufactured by Paul J. Ford and Company of Columbus, Ohio) and are well known in the industry. Other types of blind fasteners are known in the art. The blind fasteners should be installed and evenly tightened in accordance with the manufacturer's specifications, alternating between top and bottom holes on the C-channels 44 as well as on the front plate 52.

The existing flanged connection 20 and all of its bolts remain untouched during the installation of the brackets 34. There is no disassembly of the existing pole 10, and so there is no need for additional supports as would be required during any disassembly.

Each C-channel 44 can be hoisted from a small portable winch (or perhaps even by hand) on the ground with a rope run through a block strapped to the pole just above the installation location. In the case of power transmission lines, the line may remain energized if properly trained personnel are used to install the brackets 34. Also, there is no need for welding or grinding on a heavily loaded structure when making the repair using the brackets 34. This is a more permanent solution than trying to continue to monitor and repair the myriad known welding issues on these structures.

The bracket 34 is made of a material which is most appropriate for the application. For instance, it may be made out of steel, aluminum, or even a composite such as fiberglass or carbon fiber. It should be noted that the C-channels 44 may be an extrusion, a welded assembly, a unitary casting, or may be formed in other known ways.

Figure 9:
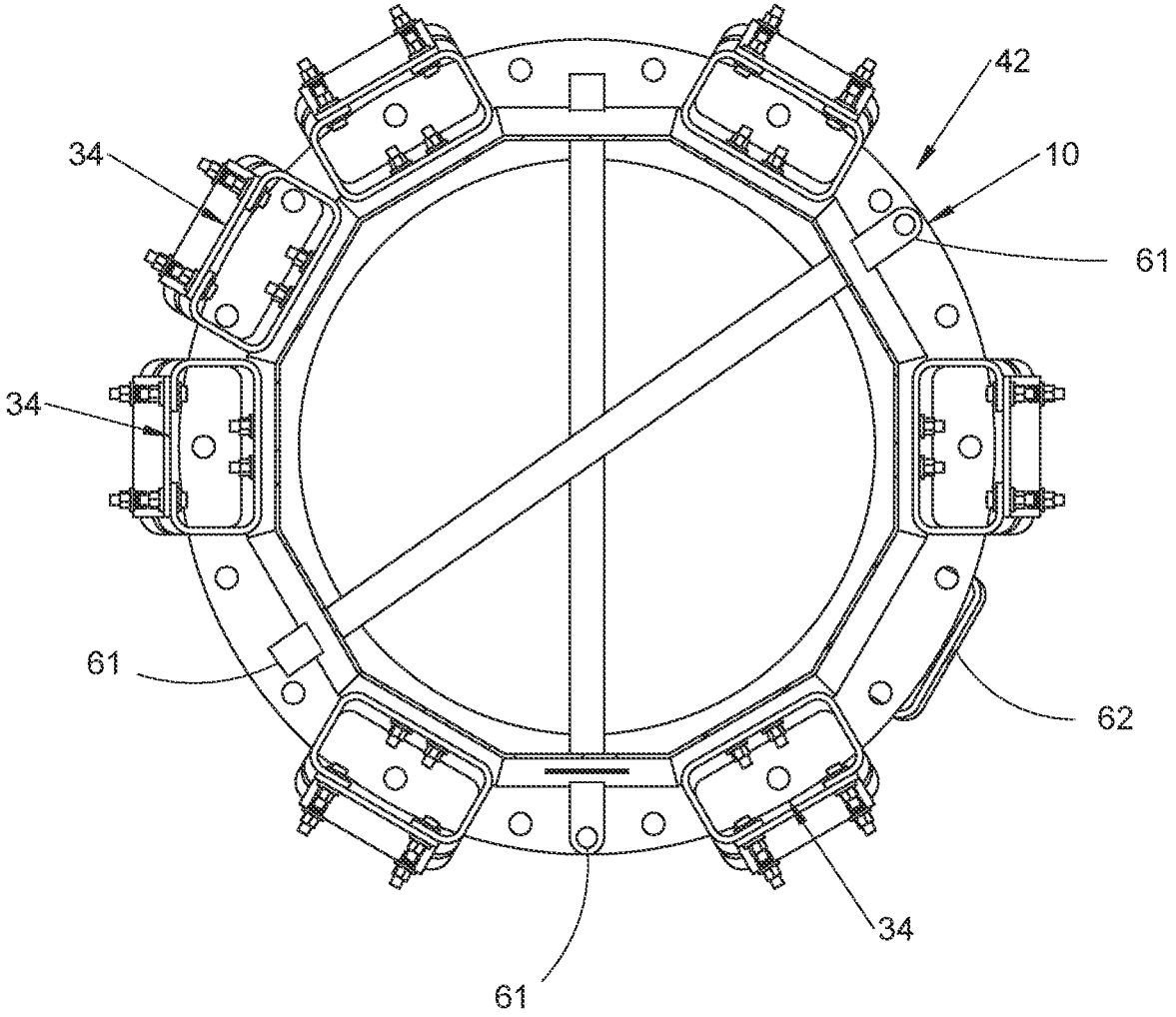
FIG. 9 is a view along section 9-9 of the pole of FIG. 2.
Figure 10:
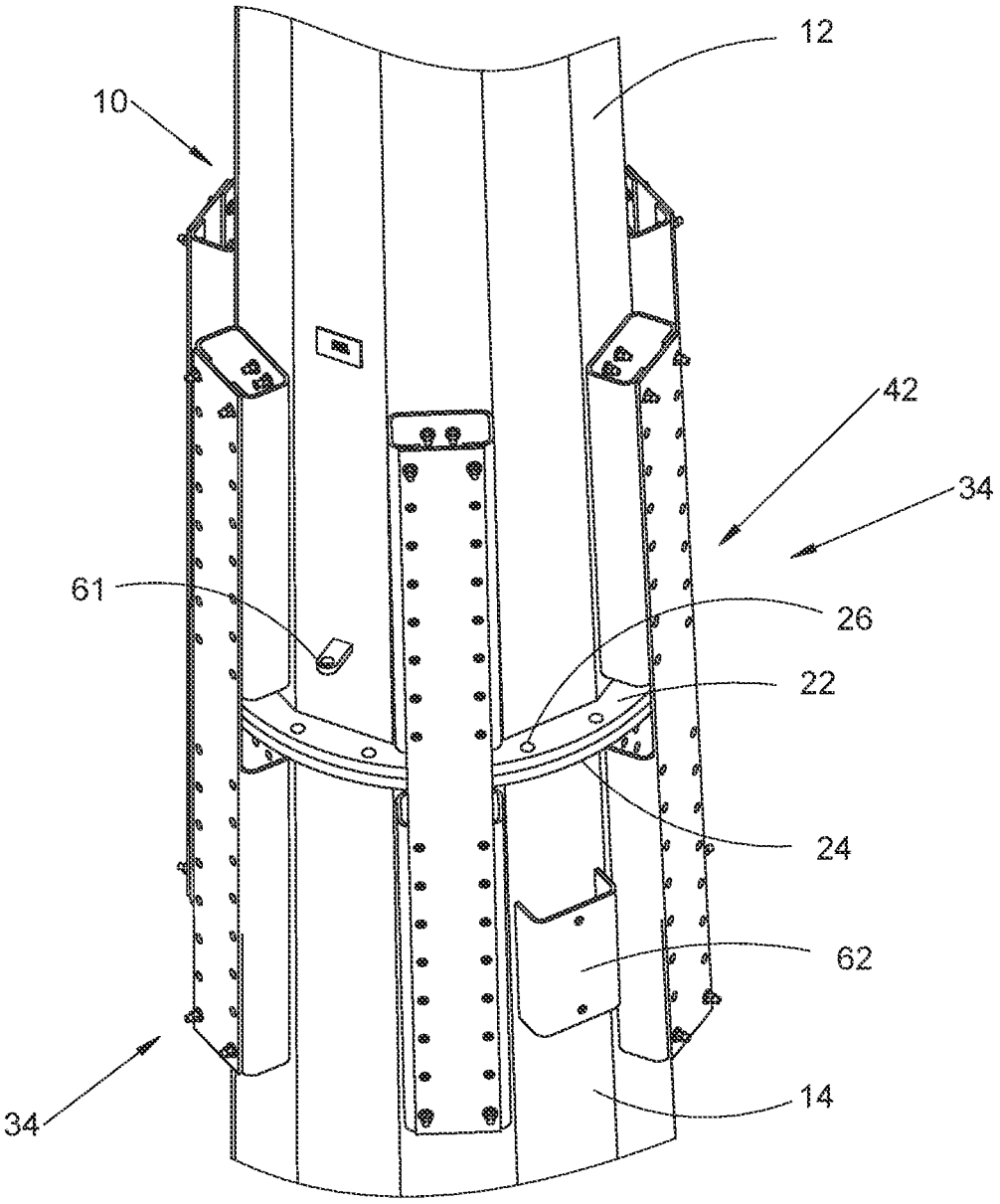
FIG. 10 is a broken-away, perspective view of the flanged-section repair and load-transfer brackets between the middle pole portion and the upper pole portion of FIG. 2.

FIGS. 9 and 10 show a repair 42 where there are some obstructions, such as vangs 61 and mounting brackets 62, which would interfere with the use of the repair 40 described above. This repair 42 uses substantially the same brackets 34 as are used in the repair 40 described earlier but does not install a bracket 34 on every side of the pole 10, skipping the sides where there are obstructions. Other than this small difference, the installation and functionality of this repair 42 is the same as that of the repair 40.

While the embodiments described above show two examples of using a bracket for making a field repair on a flanged pole, it will be obvious to those skilled in the art that modifications may be made to the embodiments described above without departing from the scope of the present invention as claimed.

What is claimed is:

1. An arrangement for repairing a flanged joint in a multi-part pole having an upper wall above the flanged joint and a lower wall below the flanged joint, comprising:

a plurality of upper C-channels, and a plurality of lower C-channels, each of said upper and lower C-channels defining a rear wall, left and right arms projecting forwardly from said rear wall, and left and right fingers extending inwardly from said left and right arms, respectively; and a plurality of front plates;

wherein each of said upper C-channels is mounted to the upper wall of said pole, with said rear wall of said upper C-channel abutting said upper wall; and each of said lower C-channels is mounted to said lower wall of said pole, with said rear wall of said lower C-channel abutting said lower wall; and wherein each of said front plates is mounted to one of said upper C-channels and one of said lower C-channels, with said front plate abutting the fingers of said one upper C-channel and said one lower C-channel and said front plate spanning across said flanged joint.

2. An arrangement for repairing a flanged joint in a multi-part pole having an upper wall above the flanged joint and a lower wall below the flanged joint, as recited in claim 1, wherein said left and right fingers in each of said C-channels define a space between said left and right fingers, and wherein said rear wall defines through-openings directly behind said space, so that said through openings can be accessed through said space for mounting said C-channels to their respective walls of said pole.

3. An arrangement for repairing a flanged joint in a multi-part pole having an upper wall above the flanged joint and a lower wall below the flanged joint as recited in claim 2, and further comprising a plurality of blind fasteners which extend through said through-openings and through holes in said upper and lower walls to secure said upper and lower C-channels to their respective upper and lower walls.

4. An arrangement for repairing a flanged joint in a multi-part pole having an upper wall above the flanged joint and a lower wall below the flanged joint as recited in claim 3, wherein said front plate defines a plurality of through openings aligned with a respective plurality of through openings defined in said left and right fingers, and further comprising a plurality of blind fasteners which extend through said through openings in said front plate and through said respective plurality of aligned openings in said left and right fingers to mount said front plate onto said upper and lower C-channels.

* * * * *